United States Patent [19]

Hoyt

[11] Patent Number: 4,501,217

[45] Date of Patent: Feb. 26, 1985

[54] SPINNAKER POLE CONTROL

[76] Inventor: John G. Hoyt, #9 Defenders Row, Goat Island, Newport, R.I. 02840

[21] Appl. No.: 583,372

[22] Filed: Feb. 24, 1984

[51] Int. Cl.[3] ..... B63H 9/4

[52] U.S. Cl. ..... 114/102

[58] Field of Search ..... 114/39, 102, 104–105, 114/108–109, 90, 91, 93, 94, 95, 96, 97, 98

[56] References Cited

U.S. PATENT DOCUMENTS 3,207,114 9/1965 Moseley ..... 114/102

3,720,180 3/1973 Stangeland ..... 114/102

4,292,910 10/1981 Hoyt ..... 114/102

*Primary Examiner*—Trygve M. Blix

*Assistant Examiner*—Jesûs D. Sotelo

*Attorney, Agent, or Firm*—Barlow & Barlow, Ltd.

[57] ABSTRACT

An improved control for a spinnaker pole is disclosed where the pole is releasably held in a sleeve on a rotatable support that has pole control line for laterally sliding the pole relative to the support, clew lines for drawing the clew out to the ends of the pole as well as pole direction changing lines.

4 Claims, 2 Drawing Figures

SPINNAKER POLE CONTROL

BACKGROUND OF THE INVENTION

In U.S. Pat. No. 4,292,910, there is disclosed the basic concept of mounting a spinnaker pole at the forward portion of a sailing vessel on a rigid support means by essentially rotatably securing the pole in a rotatable fashion on the support means and releasably holding the pole so that it could be slid transversely. Initially the control of the pole was envisioned as merely a manual moving thereof through a sleeve that served as the rotatable securing device on the top of the support means, together with a pair of lines, one of which could be termed a sheet and the other a guy. Experience dictated that it was inconvenient to go forward to move the pole, and it would be advantageous to create an easier method of handling the spinnaker completely from the cockpit.

SUMMARY OF THE INVENTION

This invention relates to a means for controlling the spinnaker pole completely from the cockpit. Essentially to set, jibe and dowse the spinnaker, one never has to leave the cockpit. For example, to set the spinnaker one merely centers the pole in the swivel mount and pulls on two more lines to haul the clews of the spinnaker out to the ends of the pole, hoists the spinnaker up the mast, and then adjusts the sheet to angle the pole in the proper direction. Since the pole is balanced, there is no pressure on either one of the sheets, or the need for any mechanical advantages as in the form of winches. To achieve the above result in a sailing vessel having a hull with a bow and stern and a mast mounted therein, a rigid support means is mounted forward of the mast, which has a support rotatably secured on the upper portion thereof which releasably holds the spinnaker pole so that the same may slide transversely thereof. For controlling the pole there are a pair of control lines, each of which is attached to its respective end of the pole, which lead toward the support means and thence through a sheave aft. In addition, a pair of clew control lines are used which are attached to the clew of the triangular sail and are thence led toward the support means through a block and thence aft of the vessel. In addition there is attached to each end of the pole a sheet so that one can angle the pole by rotating the same; and in this fashion with the six lines, complete control of the spinnaker and its attitude relative to the sailing vessel is achieved.

DETAILED DESCRIPTION OF THE PREFERRED EMBODIMENT

Figure 1:
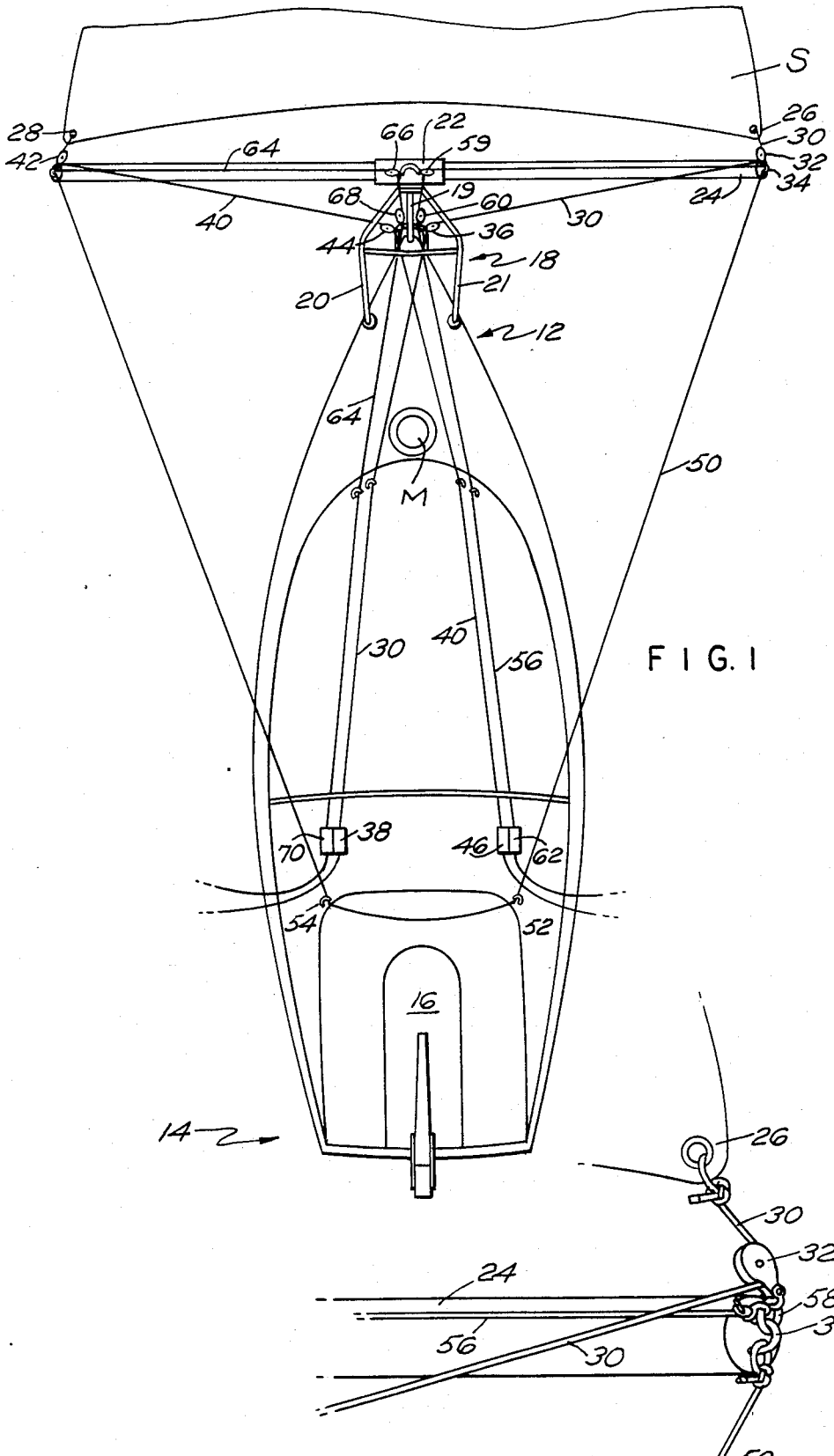
FIG. 1 is a view partially diagramatic looking down on the hull of a sailing vessel showing the orientation of the control lines.
Figure 2:
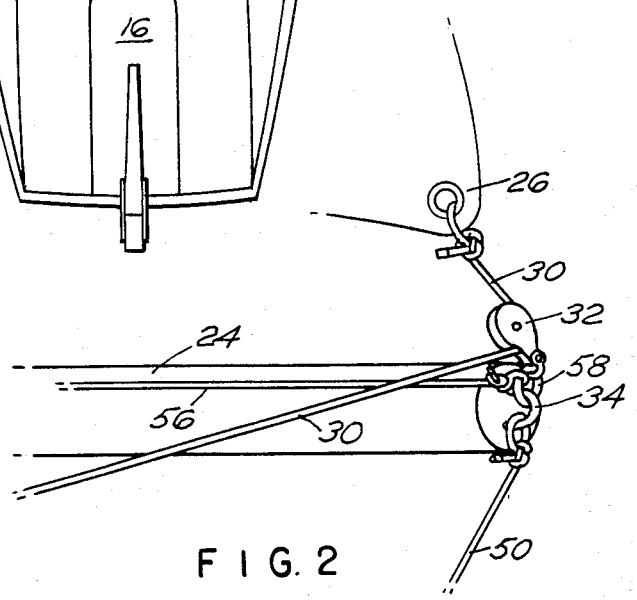
FIG. 2 is an elevational view greatly enlarged of one end of the spinnaker pole, showing the manner in which the various lines are attached.

Referring now to the drawings, particularly FIG. 1, a vessel is shown in plan, having a bow section generally indicated at 12 and a stern section generally indicated at 14, at which location there is a cockpit area 16. Mounted on the bow of the vessel is a rigid support means in the form of a modified pulpit 18 which is formed of three vertical posts, there being a forward post 19 and two other posts 20 and 21 spaced somewhat along the gunwales and aft of the bow post 19, all of the posts being joined together by horizontal members. At the top of the forward post 19 is swivably mounted a sleeve 22 which receives for sliding movement therein a spinnaker pole 24. The sailing vessel will be fitted with a mast M, and on the mast spaced a considerable distance above the deck will be located a sheave through which a halyard may pass, and this halyard (not shown) will be connected to a spinnaker S which in effect is a triangular sail with a balloonshaped body having a pair of clews 26, 28. In order to set the sail at either end of the spinnaker pole, a line 30 is attached to the cringle at the clew 26 and then passes through a block 32 fastened to the end of the spinnaker pole in a suitable fashion, as by shackling the same to a fastening U-bolt 34. The line is thence led inwardly toward the base of the post 19 where it passes through a turning block 36 and is thence led preferably toward the port side of the vessel to a locking stopper 38 that is in the form of a jam cleat. For the other clew 28 a similar line 40 leads from the clew through a turning block 42, thence to the base of the post 19 and through a turning block 44 to be led aft to a stopper in the form of a jam cleat 46. With the two clew lines, the sail may be hoisted first, and thence the clew lines pulled to extend the sail outwardly on the pole.

For adjustment of the pole relative to the hull, pole lines 50 are provided, which are shown in the form of a continuous line that leads through suitable guide eyes such as 52, 54 adjacent the cockpit 16, and are fastened at each end of the pole as to the U-bolts 34. In addition it is desirable to move the pole laterally through the sleeve 22, and to achieve this, pole adjustment lines such as the starboard line 56 is seen as attached to the pole end as to a ring 58 that provides swivelling action on the U-bolt 34; and this line 56 is led toward the sleeve 22 through a turning block 59, and thence down to the deck level at the base of the post 19 and through another turning block 60, from whence point the line leads aft to a stopper in the form of a jam cleat 62. Similarly the port end of the pole has a line 64 attached thereto that passes through a turning block 66 on the sleeve 22 and thence down through another turning block 68 at the base of the post 19, from which point it is led aft to a stopper or cam cleat 70.

It will be, of course, noted that the stoppers 38, 46, 62 and 70 are all located adjacent the cockpit 16 along with the spinnaker pole line 50, so that complete control of the spinnaker can be had directly from the cockpit. This arrangement therefore allows one to not only set the spinnaker as has been briefly described above, but also jibe the same by pulling on the line 50 in one direction or the other, and also to dowse the spinnaker from one location, namely the cockpit. In dowsing the spinnaker, the spinnaker is adjusted behind the mainsail (not shown) so that the same will collapse, and then the clew lines 30 and 42 are released, and by the use of a down halyard (not shown) that is led through the turtle, the spinnaker may be completely pulled down on the foredeck and into a turtle, which is in the form of a bag that may be located on the foredeck.

I claim:

1. In a sailing vessel having a hull with bow and stern sections, a mast supported in a vertical direction from the hull; a rigid support means forward of the mast having means rotatably secured on the upper portion thereof for releasably holding a spinnaker pole, which can slide transversely thereof; that improvement for controlling the pole comprising a pair of control lines, one each attached to an end of said pole and thence led aft through direction changing means at said support means, a pair of clew control lines, each led from the clew of a triangular sail through direction changing means at the bow of the vessel, and thence aft for controlling the sail.

2. In a sailing vessel as in claim 1 wherein a continuous pole control line is provided having its ends fastened to the pole and thence led aft.

3. In a sailing vessel as in claim 1 wherein the control and clew lines are passed through stoppers at the aft portion of the vessel.

4. In a sailing vessel as in claim 1 wherein the direction changing means for the control lines are located on the sleeve and at a lower portion of the rigid support means.

* * * * *